United States Patent [19]

Herubel

[11] 4,026,097

[45] May 31, 1977

[54] WINDING-ON FLYER FOR A ROVING FRAME

[75] Inventor: Jean Frederic Herubel, Guebwiller, France

[73] Assignee: N. Schlumberger & Cie, Guebwiller, France

[22] Filed: June 3, 1975

[21] Appl. No.: 583,446

[30] Foreign Application Priority Data

June 6, 1974 France ..... 74.19560

[52] U.S. Cl. ..... 57/117
[51] Int. Cl.[2] ..... D01H 7/32
[58] Field of Search ..... 57/67–70, 57/115–117

[56] References Cited

UNITED STATES PATENTS

| | | | |
|---|---|---|---|
| 2,535,736 | 12/1950 | Hattersley | 57/117 |
| 2,814,177 | 11/1957 | Meyer-Busche | 57/117 |
| 2,873,571 | 2/1959 | Robinson | 57/117 |
| 3,389,547 | 6/1968 | Kuhl | 57/117 |
| 3,472,013 | 10/1969 | Grishin et al. | 57/70 |
| 3,624,998 | 12/1971 | Mackie | 57/115 |
| 3,782,099 | 1/1974 | Schwager | 57/117 |

*Primary Examiner*—John Petrakes
*Attorney, Agent, or Firm*—Toren, McGeady and Stanger

[57] ABSTRACT

The body of the flyer provides two identical limbs and is formed as a single hollow piece and in that the roving guide is constituted by a tube housed inside the corresponding limb and extending on the one hand into the upper part of the hollow shaft and on the other hand, into the corresponding arm.

1 Claim, 8 Drawing Figures

IV
II
11
V
3
5
4
VI
17
VII
VI
IV
VIII
21
26
VIII
VIII
25
II
7
6
14
28
22
27
13

11
3
1A
1B
2
5
25
25
17

WINDING-ON FLYER FOR A ROVING FRAME

This invention relates to winding-on flyers, for roving frames, of the kind comprising a body integral with a shaft and provided with two limbs extended by arms one of which bears a roving guide and a presser finger while the other forms a balancing counterweight.

On roving frames, the winding-on flyers are mounted for rotation about a vertical axis, and a roving of textile fibres, issuing from a pair of delivery cylinders of a drafting system, enters into the upper part of the flyer which imparts a twist to it; then the roving follows one of the limbs of the flyer and passes over the pressure finger which winds it into a bobbin being formed between the two limbs of the flyer and which is subjected to alternating raising and lowering movements.

A known conventional form of flyer comprises a solid arm and an arm having a lateral groove for passage of the roving. Another form of flyer is formed as a casting made as a single piece which comprises the axle, the body and the two limbs one of which has, cast integrally therewith, a guide conduit for guiding the roving from the upper part of the body of the flyer to the presser finger. Finally, there are known in addition flyers having two solid limbs along one of which a roving guide tube is fixed.

These different types of known flyers all have more or less serious disadvantages which do not allow their use on modern high speed machines. In fact:

The centrifugal force tends to cause the limbs of the flyers to separate from one another to such an extent that one is obliged to limit their speed of rotation to a predetermined safety value. The deformation of the limbs arising from such centrifugal force is not only a source of irregularities in the wound-on roving, but, moreover, it can result in collision of adjacent flyers if the distance which separates them is very small. It can even happen that flyers break under the effect of the centrifugal force if their speed of rotation is too great, and this, of course, constitutes a source of danger for personnel. In order to avoid this serious danger, various protective devices such as screens placed in front of the flyers, have been proposed but these screens constitute a complication and a hinderance in the operation of the machine.

Given that the two limbs of the flyer are of different constructions, their dynamic equilibrium is rarely realised, since the centrifugal force is not exerted equally on the limbs, so that they do not move away from the axis of rotation to the same extent, which results in poor functioning of the machine and, more especially, generation of vibrations.

Moreover, a strong current of air is created in the upper part of the hollow arm of the flyer, and this results in fibre accumulations, arising detached fibers, occuring along the groove in which the roving passes over one of the two arms of the flyer, so that these accumulations have to be removed from time to time, which necessitates stoppage of the machine and, consequently, causes reduction in output. Currents of air can also be produced in the zone exterior to the flyers, which can cause irregularities, or even breakages, in the rovings; moreover, fibres become scattered in the atmosphere and inconvenience personnel, without taking into account the increase in the consumption of energy which results therefrom.

An object of the invention is to flyer a winding-on flyer for a roving frame which does not since the above-discussed disadvantages of the conventional flyers.

To this end, the flyer in accordance with the invention is characterised in that the body provides two identical limbs and is formed as a single hollow piece and in that the roving guide is constituted by a tube housed inside the corresponding limb and extending on the one hand into the upper part of the hollow shaft and the other hand, into the corresponding arm.

Because of its special structure, the flyer of the invention offers a considerable resistance to centrifugal force, since the moment of inertia of the straight sections of its limbs is greater than that of the section of the limbs of conventional flyers. All the disadvantages resulting from the effects of the centrifugal force discussed above are therefore eliminated.

Since the two limbs of the flyer are of indentical construction, the dynamic equilibruim of the whole assembly of the flyer is much better than that of the conventional flyers; its two limbs therefore move apart symmetrically relative to the axis of rotation of the flyer, which allows increase of its speed of rotation and, consequently, of the output of the machine, without disadvantages, more especially vibrations, resulting therefrom.

Given that the two arms of the flyer are closed, that is say to that one of them does not comprise a groove for guiding the roving, accumulations of fibres are no longer produced along such groove, so that one is no longer obliged to stop the machine in order to eliminate them. Furthermore, the structure no longer produces a current of air in the zone external to the flyer and consequently, the disadvantages which used to result therefrom are avoided.

The flyer in accordance with the invention can be realised, for example, from cast metal or from two symmetrical welded parts.

The invention will be described further, by way of example, with reference to the accompanying drawings which illustrate, by way of a non-restrictive example, one embodiment of a winding-on flyer for a roving frame constructed in accordance with the invention.

Figure 1:
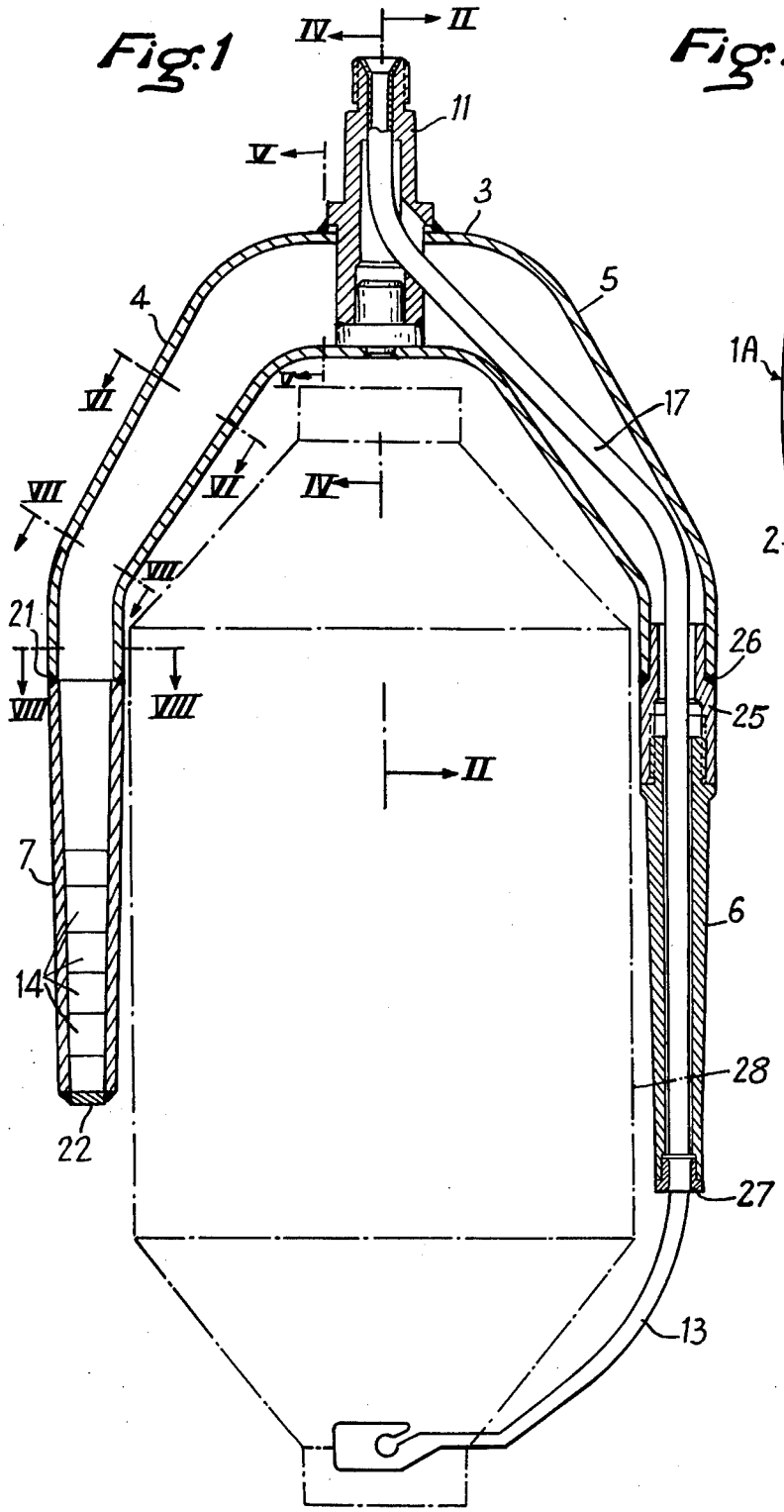
FIG. 1 is a sectional side elevation of the said embodiment, showing the same in position relative to a bobbin.
Figure 2:
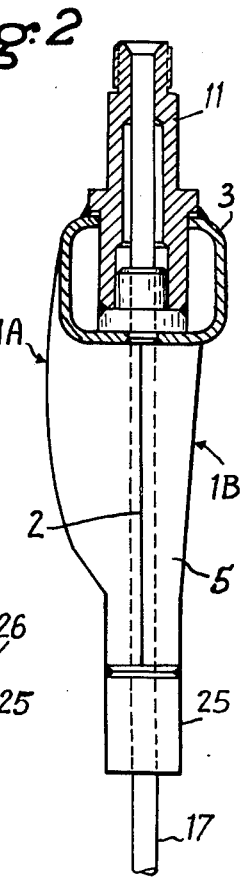
FIG. 2 is a fragmentary section taken along the line II—II of FIG. 1.
Figure 3:
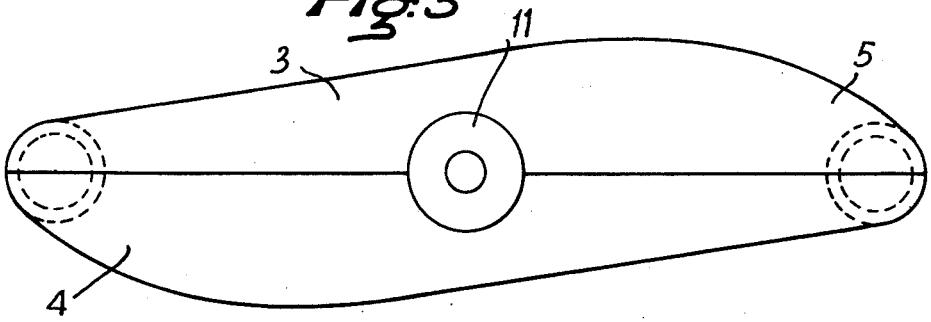
FIG. 3 is a plan view corresponding to FIG. 1; but with the bobbin omitted.
Figure 4:
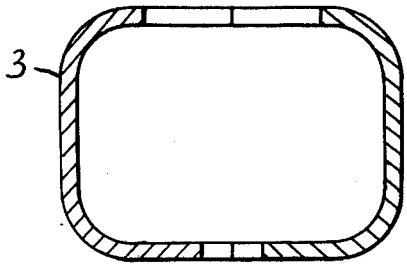
FIGS. 4 to 8 are detached sections, taken respectively along the line IV—IV, V—V, VI—VI, VII—VII and VIII—VIII of FIG. 1 of the body of the flyer of FIG. 1.
Figure 7:
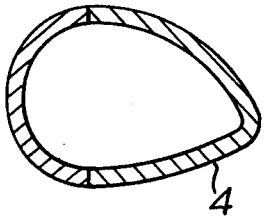
Figure 5:
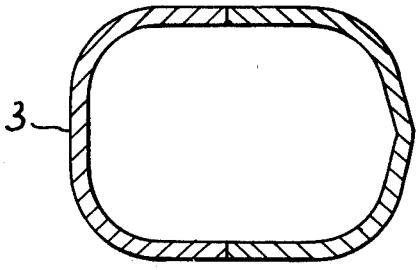
Figure 8:
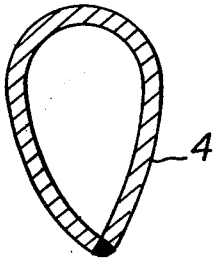
Figure 6:
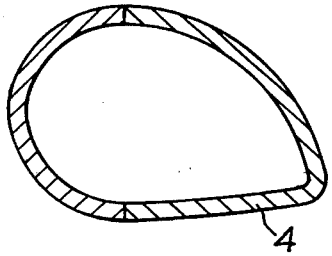

The winding-on flyer, for a roving frame, illustrated in the drawings is formed of two stamped or cast half-shells, welded to each other along a joint plane which, in this example, is situated at the location indicated by the reference numeral 2 in FIG. 2. The two half-shells together form a body 3 having two limbs 4, 5 which are provided with respective extensions or arm 6, 7. Fixed in the middle of the central part of the body 3 is a hollow pivot or shaft 11 which projects above the body. This shaft 11 supports the flyer and serves to enable it to be rotated. The arm 6 carries a presser finger 13, whilst arranged in the other arm 7 are balancing counterweights 14.

A roving guide tube 17 is housed inside the limb 5 and extends, on the one hand, into the upper part of the hollow shaft 11 and, on the other hand, into the arm 6. This roving guide tube can, for example, be made of metal or of a plastics material.

In the example shown, the hollow shaft 11 is welded to the body 3 of the flyer, and the arm 7, which contains the balancing counterweights, is welded at the end to the corresponding end of the limb 4, as indicated by weld bead 21. The arm 7, which is tubular, is closed at its lower end by a closure 22 welded to this end.

The other arm 6, which carries the pressure finger 13, is screwed by its upper end into a sleeve 25 which is socketed into the corresponding end of the limb 5 of the flyer with which it is made integral by a weld bead 26. Fixed in the lower end of the arm 6 is an eyelet 27 for guiding roving when leaving the arm 6.

In operation, the roving therefore enters into the upper end of the tube 17, descends through the latter into the hollow limb 5 and the hollow arm 6, then over the presser finger 13 in order to be wound in formation onto the bobbin 28 which is driven with conventional raising-and-lowering movements, whilst the flyer is rotated about its axis.

To improve the output of the roving frame to which the flyer is fitted and to reduce the consumption of energy while attaining greater rotational speeds for the flyers, the body 3 and its legs 4 and 5 has been formed, so far as is possible, with aerodynamic profiles established as a function of the direction of rotation of the flyer, as shown in detail in FIGS. 4 to 8.

In the example shown, it has been assumed that the joint plane 2 of the two half-shells is situated in the plane of the axes of the two arms of the flyer, but a different construction could be adopted, for example by arranging the joints in planes perpendicular to the plane of the axes of the two arms of the flyer.

Of course, the invention is not limited to the embodiment described and shown, and modifications can be made thereto, without departing from the scope of the invention. Thus, for example, the hollow piece could be cast in a single piece, and the roving guide tube, for example made of metal, can be cast in situ at the time of moulding. The guide tube could, however, be semi-flexible, for example made of a plastics material, and subsequently inserted in place by threading into the said hollow piece.

What I claim is:

1. A winding-on flyer for a roving frame comprising a hollow shaft with an upper part and a lower part, a hollow body integral with and symmetrically arranged about the lower part of said shaft, said hollow body being of inverted-U shaped configuration providing a pair of identical hollow limbs each having an upper end connected to said shaft and a lower end, a first arm forming an extension of one of said limbs and constituting a counterweight, said first arm comprising a first end connected to the lower end of the one of said limbs and second free end depending downwardly from the one of said limbs a second arm forming a respective extension of the second one of said limbs, said second arm comprising a first end connection to the lower end of the second one of said limbs and a second free end depending downwardly from the second one of said limbs, a presser finger carried by said second arm at the second end thereof, and a roving guide tube disposed within said second arm and extending upwardly through the interior of said second of said limbs, said body, with its said limbs, being formed as a unitary hollow piece comprising two shaped half shells of sheet metal welded together in edge-to-edge relation, and said roving guide tube extending from said second of said limbs into said upper part of said shaft whereby said roving guide tube extends as a continuous member from the top of the shaft down to the outlet from the lower end of said second hollow limb.

* * * * *